US005644875A

United States Patent [19]

Nielsen

[11] Patent Number: 5,644,875

[45] Date of Patent: Jul. 8, 1997

[54] SEALING ARRANGEMENT FOR A GLASS-CARRYING WINDOW FRAME

[75] Inventor: Elgård Schandorff Nielsen, Ostbirk, Denmark

[73] Assignee: V. Kann Rasmussen Industri A/S, Soborg, Denmark

[21] Appl. No.: 457,121

[22] Filed: Jun. 1, 1995

Related U.S. Application Data

[63] Continuation-in-part of PCT/DK93/00391 Dec. 1, 1993.

[30] Foreign Application Priority Data

Dec. 4, 1992 [DK] Denmark ..... 1460/92

[51] Int. Cl.[6] ..... E06B 7/14

[52] U.S. Cl. ..... 52/204.591; 52/204.69; 52/204.7

[58] Field of Search ..... 52/204.5, 204.591, 52/204.69, 204.7

[56] References Cited

U.S. PATENT DOCUMENTS

| | | | |
|---|---|---|---|
| 4,612,743 | 9/1986 | Sälzer | 52/204.591 X |
| 4,703,598 | 11/1987 | Wilson et al. | 52/204.591 X |
| 5,058,344 | 10/1991 | Biebuyck | 52/204.591 X |
| 5,095,676 | 3/1992 | Mühle | 52/204.591 X |
| 5,105,593 | 4/1992 | Kaminaga et al. | 52/204.591 X |

FOREIGN PATENT DOCUMENTS

| | | | |
|---|---|---|---|
| 4303874 | 8/1994 | Germany | 52/264.5 |

*Primary Examiner*—Carl D. Friedman
*Assistant Examiner*—Yvonne Horton-Richardson
*Attorney, Agent, or Firm*—Lane Aitken & McCann

[57] ABSTRACT

A sealing arrangement for a glass-carrying window frame comprises sealing profiles of an elastomeric material placed between the inner side of the insulating glass pane (1) and planes on the frame members facing the said inner side. A first sealing profile (8) is placed on the side members (2*a*) of the frame, and has a drainage channel (15*a*) facing the light aperture of the window. A second sealing profile (16) is placed in contact with the inner side of the insulating glass pane and together with the insulating glass pane (1) forms a substantially V-shaped drainage channel (22). In the corner joints between the bottom member (2*b*) and the side members (2*a*) drainage openings (23) are provided by a depression of the side of the second sealing profile (16) facing the insulating glass pane, such that the said second profile during passage under the first sealing profile (8) is extended out to an exterior wall of the side member (2*a*), while the first sealing profile (8) is passed over the second sealing profile (16).

5 Claims, 4 Drawing Sheets

SEALING ARRANGEMENT FOR A GLASS-CARRYING WINDOW FRAME

Figure 1:
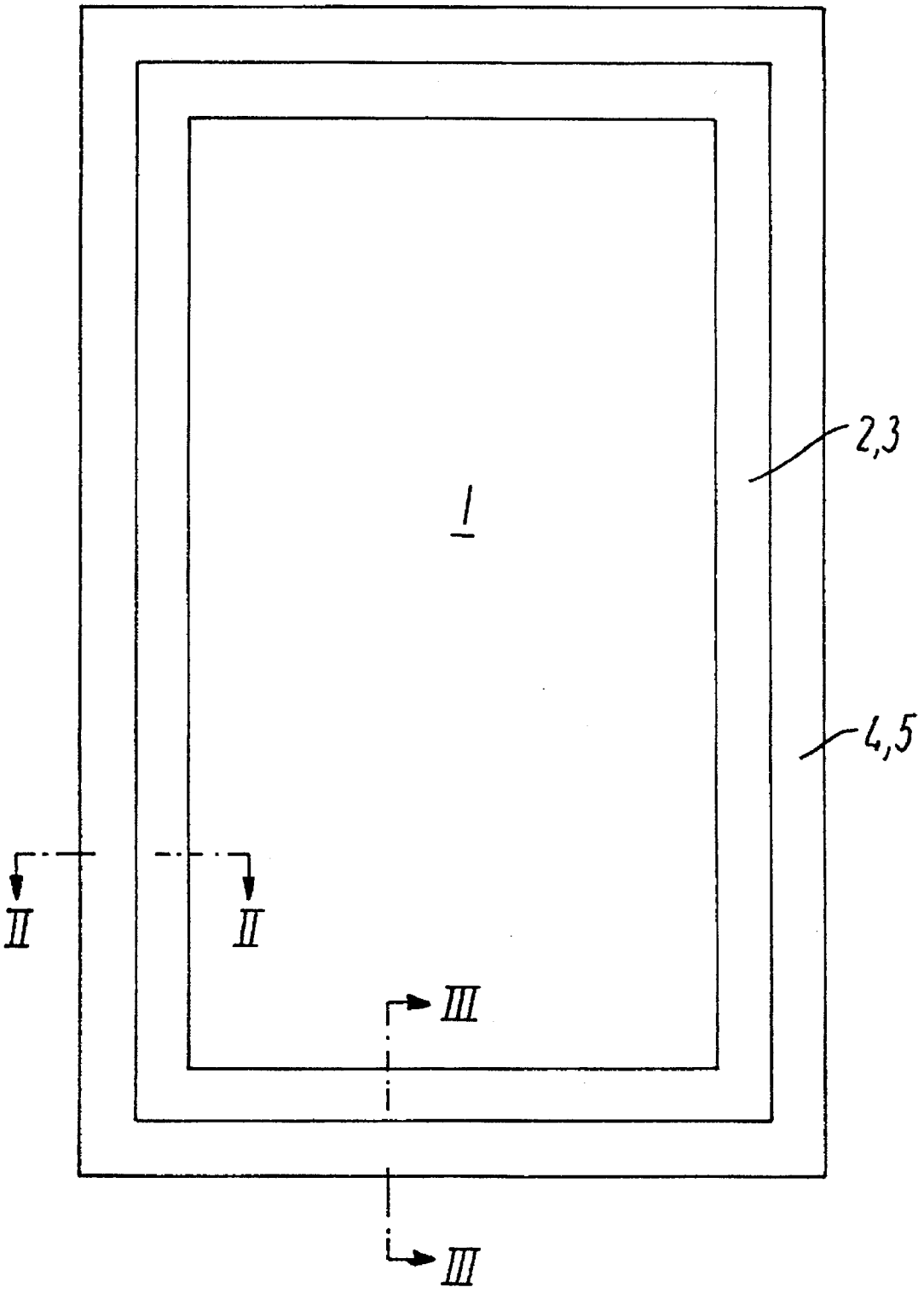

This application is a continuation-in-part of international patent application PCT/DK93/00391 designating United States of America.

The invention relates to windows of the type where an insulating glass pane is kept in contact with a glazing recess in the side and top members of the frame and with the frame bottom member by means of exterior glazing profiles, and where a sealing arrangement including profiles of an elastomeric material is interposed between the inner side of the pane and the surfaces of the frame members facing the pane to provide drainage openings in order to drain off condensed water produced on the inside of the pane.

It is well known that dew may occur on the inside of insulating glass panes of windows and skylights when the outside temperature becomes sufficiently low to cool down the inner side of the glass to a temperature below the dew point of the air in the room. The formation of dew can become great, even to such an extent that condensed water may collect at the bottom member of the frame, which especially in the case of wooden frames or window cases may lead to moisture damage.

From DE-U-8229620.0 a sealing arrangement of the type mentioned above is known, where a sealing arrangement is utilized in connection with the bottom member of the frame of a skylight to be installed in an inclined roof. This sealing arrangement comprises a triangle-like boss as a support for the insulating glass pane, where the said boss in one or more places is traversed by channels or grooves, such that condensed water collected in the overlying slot between the insulating glass pane and the part of the seal serving the purpose of protecting the wood from becoming wet may be drained off to the outdoors.

From GB-A-2144791 a further sealing arrangement of the above-mentioned kind is known, in which only on the bottom member of the frame a sealing profile is placed to provide a trough for receiving condensate and transport it to the outside by means of drainage channels.

In an other design, known from GB-B-2070117, a water absorbent material is provided in a slot between the bottom edge of the insulating glass pane and a sealing flap, which protects the wood of the bottom member of the frame, the water absorbent material serving to reduce the flow of air from the outdoors.

All these prior art structures have in common that in spite of the explained precautions there remains a risk of condensed water penetrating through to the wood at the corner joints if these are not fully sealed, as the amount of condensed water normally will be greater here than at the middle of the frame bottom member, since the cooling of the insulating glass pane is normally most severe at the corners.

On this background it is the object of the invention to provide a new sealing arrangement by which the problems pertaining to condensed water to a much greater degree are avoided, i.e. by a design, which assures that even large amounts of condensed water can be drained off to the external side of the window.

According to the invention a window is provided, having a frame comprising a top member, a bottom member and side members, each of said side members being formed with a recess having a bottom wall and a side wall, for receiving side edges of an insulating glass pane with an inner side of said pane facing the bottom wall of said recess, external glazing profiles for arrangement on external sides of said side and bottom members to retain said pane in said recesses and against said bottom member and a sealing arrangement comprising first and second sealing profiles of an elastomeric material for arrangement between the inner side of said pane and opposing surfaces of said recesses and said frame bottom member, respectively, siad first sealing profile being provided with a first pair of projecting flaps facing the window opening and providing a drainage channel extending in the longitudinal direction of the respective frame side members, said second sealing profile facing against the inner side of the pane a substantially V-shaped drainage channel and being formed at the side facing said pane at each of two corner joints between the frame bottom and side members with a depression forming a drainage opening, said first and second sealing profile crossing each other at said corner joint to provide a drainage communication between said longitudinally extending drainage channel in said first sealing profile and said drainage opening.

By this design of the sealing profiles and corner joints it is assured that even large amounts of condensed water can be drained off to the external side of the window through the drainge openings in the corners, the sealing profiles being at the same time positioned such that even at the corner joints they provide good protection of the wooden parts against the penetration of moisture.

The sealing arrangement of the window according to the invention is furthermore of a relavtively simple and inexpensive design, and may be utilized for both skylights and facade windows.

Figure 2:
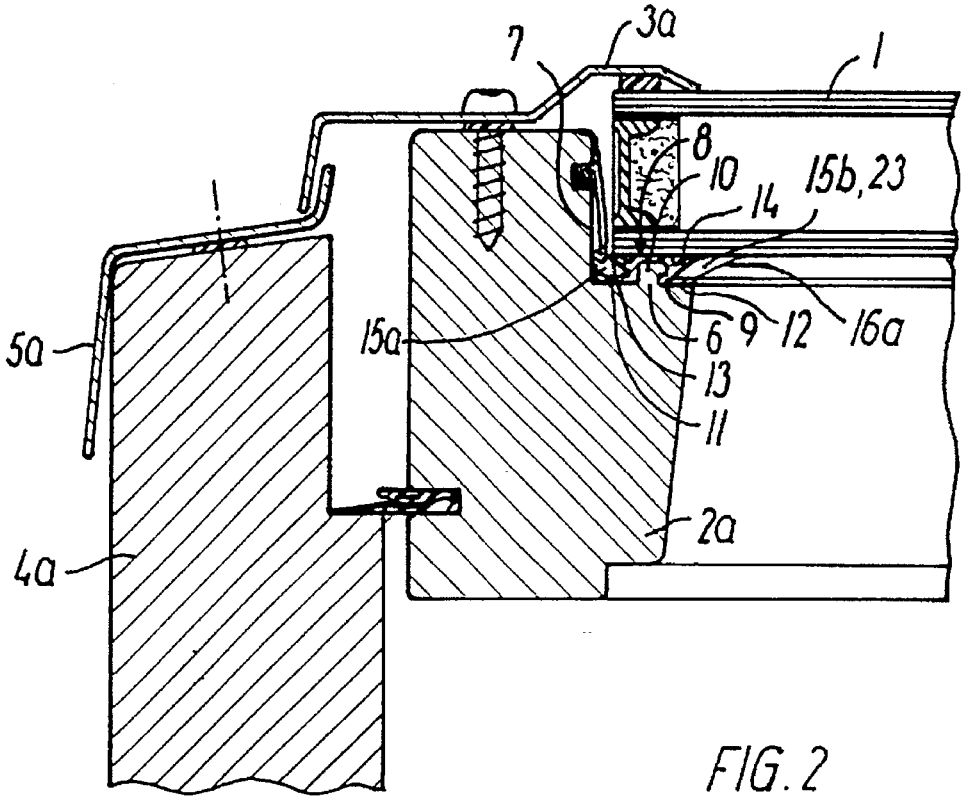
Figure 3:
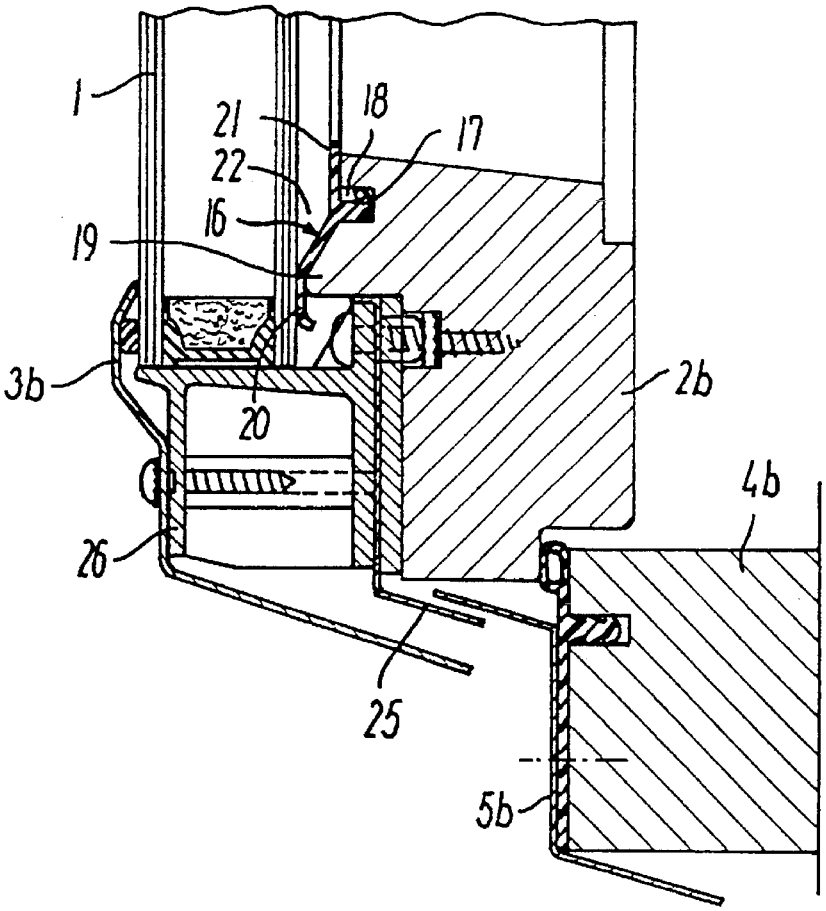
Figure 4:
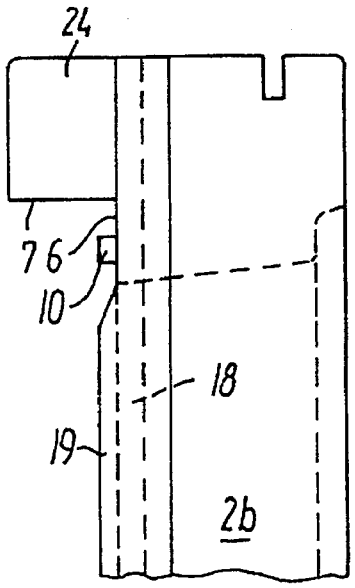
Figure 5:
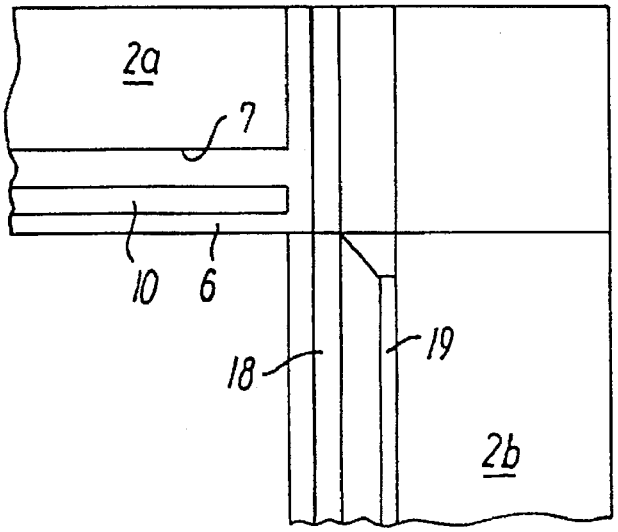
Figure 6:
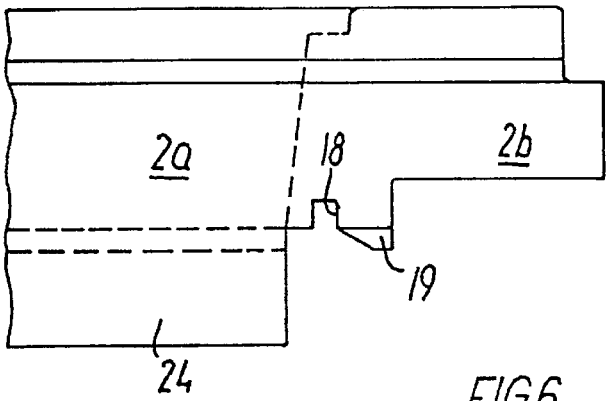
Figure 7:
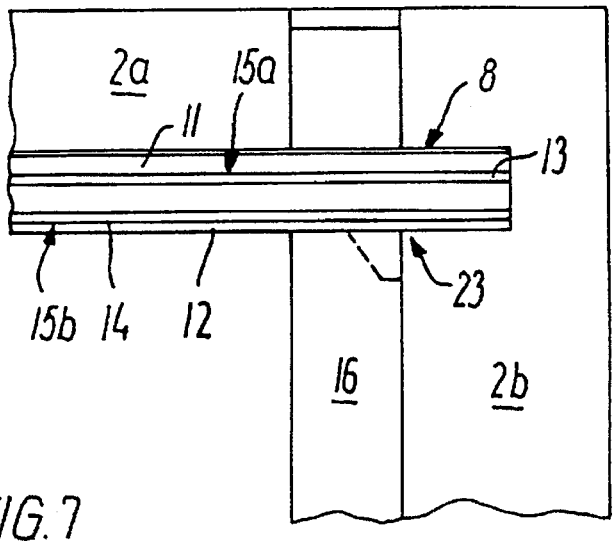
Figure 8:
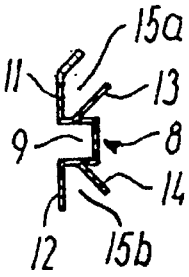

In the following the invention will be described in more detail with reference to the schematic drawing, where FIG. 1 shows a top-hung window seen from the outside;

FIGS. 2 and 3 are sectional views along the lines II—II and III—III in FIG. 3;

FIGS. 4–7 details of the embodiment of a corner joint;

FIG. 8 a detail of a sealing arrangement shown on a larger scale; and

Figure 9:
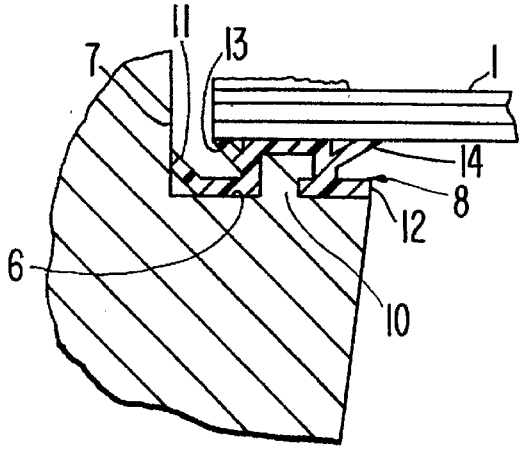
Figure 10:
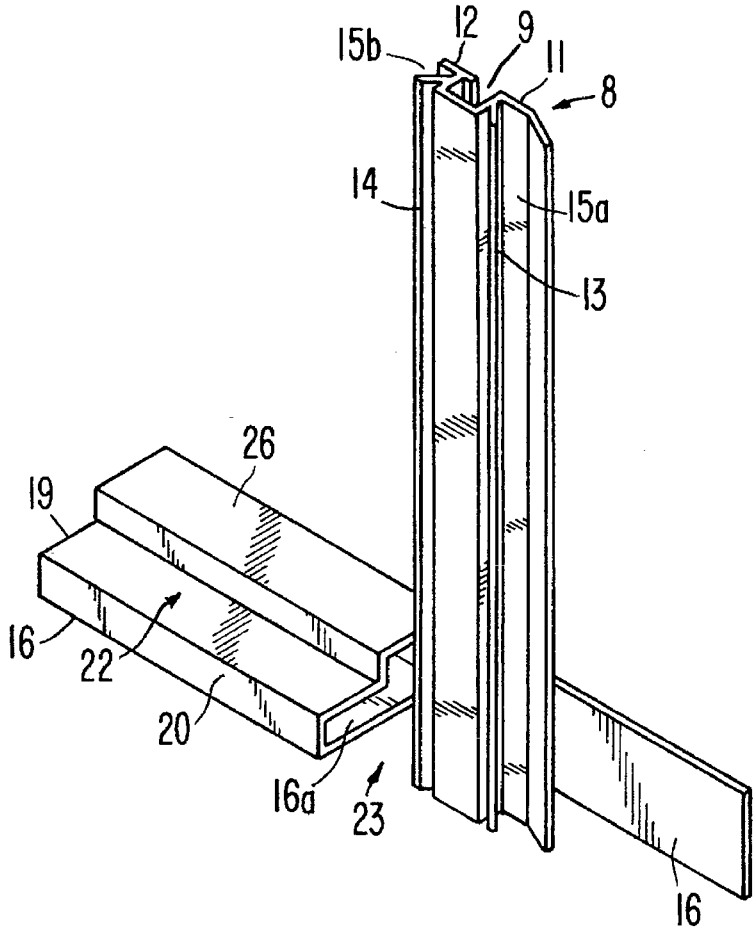

FIG. 9 is an enlarged cross section of the sealing profile and glazing recess of the window of FIG. 2; and FIG. 10 is a perspective view of first and second sealing profiles of the sealing arrangement crossing each other at the lower corner joints of the window.

The window shown in FIG. 1 comprises an insulating glass pane 1 placed in a glass-carrying frame 2, which on the outside in a known manner includes a glazing profile 3, which serves both as a support for the insulating glass pane and as a weather screen. The frame 2 with the insulating pane 1 is top-hung in a main frame 4, which likewise in a known manner may be provided with an external weather screen.

In the sectional view of the side members of the frame and main frame structures shown in FIG. 2, the side member of the frame is denoted as 2*a*, and the side member of the main frame as 4*a*, while the external glazing profile and weather screen on the frame member is denoted as 3*a*, and the external weather screen on the side member of the main frame is denoted as 5*a*. In order to accommodate the insulating glass pane 1 a glazing recess is provided in each side member of the main frame, said glazing recess comprising a bottom wall 6 and a side wall 7. A first sealing profile 8 is attached to the bottom wall 6 of the glazing recess facing the inner side of the insulating pane 1. In the embodiment shown sealing profile 8 is fixed by means of a groove 9 in the underside of the sealing profile engaging with an upwardly protruding rib 10 on the bottom wall of the glazing recess.

The sealing profile 8 covers the bottom 6 of the glazing recess over its entire width, and may, as shown in FIG. 8, be designed with outwardly projecting flaps 11 and 12 directed towards the side wall 7 of the glazing recess and the opening of the window, respectively. As can best be seen from FIGS. 2 and 9, the flap 11 has such a width that its outer edge is placed in tight contact with the side wall of the glazing recess. Directly connected to the groove 9 the profile furthermore has obliquely outwards directed flaps 13 and 14, of which the flap 13 together with the flap 11 provides a first pair of flaps forming a longitudinally extending drainage channel 15*a*, while the flap 14 together with the flap 12 provides a second pair of flaps forming a drainage channel 15*b* facing the aperture of the window.

The drainage channel 15*b* mentioned above causes effective drainage during the increasing formation of drops as a result of dew, which is formed first at the edges of the insulating glass pane, as the temperature is lowest here. The drainage channel will in practice have the effect that condensation drops as a result of the formation of dew so to speak are pulled into the drainage channel 15*b*, which channelizes the drops downwards into the corner joints between the side members of the frame and the bottom member of the frame.

The bottom member of the frame and its corresponding glazing profile and weather screen are in the sectional view shown in FIG. 3 denoted as 2*b* and 3*b*, while the bottom member of the main frame and its corresponding weather screen are denoted as 4*b* and 5*b*. A second sealing profile 16 is placed between the insulating glass pane 1 and the frame bottom member by engagement of a bead 17 on the rear side of the profile with a longitudinally extending groove 18 in the frame bottom member 2*b*. The profile is furthermore held in contact with the inner side of the insulating glass pane 1 in the shown embodiment in that the frame bottom member 2*b* is provided with a projecting nose portion 19, which provides support for an outwardly protruding flap 20 of the sealing profile 16. This contact, however, may be achieved in another manner by a suitable variation in the thickness of the sealing profile. On the other side of the bead 17 the wood of the frame bottom member 2*b* in a direction towards the window aperture is covered by a corresponding upwardly protruding flap 21, such that the sealing profile 16 partly is in close contact with the insulating glass pane, and partly covers the side of the frame bottom member 2*b* containing the nose portion 19 and facing the insulating glass pane 1.

Together with the insulating glass pane 1 the outwardly protruding flap 20 of the sealing profile 16 forms a substantially V-shaped drainage channel 22, which extends along the entire width of the frame bottom member and out towards the corner joints at the side members of the frame.

The embodiment of the corner joints is most clearly presented in FIGS. 4–7, and the design of the sealing profiles 8 and 16 in FIGS. 8 and 10.

In connection with the V-shaped drainage channel 22 in the bottom member of the frame a drainage opening 23 is provided by means of a depression 16*a* formed in the side of the sealing profile 16 facing the insulating glass pane. In the embodiment shown this is achieved in that the nose portion 19 of the frame bottom member 2*b*, as is most clearly seen in FIGS. 4 and 5, ends a certain distance from the side wall 7 of the glazing recess of the frame side member 2*a*. A profiled strip 24, which forms the side wall 7 of the glazing recess and which belongs to the frame side member 2*a*, is likewise cut off immediately above the bottom member 2*b*, as is most clearly apparent in FIGS. 5 and 6.

As a result of the depression of the sealing profile 16 formed thereby, the profile may be arranged to pass underneath the sealing profile 8 in intercrossing relationship and to extend outwards to an exterior wall of the side member 2*a*, while the sealing profile 8 in turn may cross the sealing profile 16 in overlying relationship, such that the drainage channel 15*b* is caused to communicate with the drainage opening 23.

The extension of the sealing profiles 8 and 16 obtained by the overlapped crossing ensures a particularly good protection of the corner joints, and in result, drops of condensate, which are channelized down through the drainage channel 15*b* in the profile 8, are safely drained off to the external side, and the same is the case for condensed water collecting in the V-shaped channel 22 in the bottom member.

As is apparent in FIG. 3, the draining off of water may take place in that the condensed water, which is led to the corners through the channels 15*a*, 15*b* and 22, is drained off by means of a shield 25, which provides protection on the exterior side of the part of bottom member of the frame 2*b* lying below the insulating glass pane 1, and which may be fixed by means of glass supports 26, which provide a stop for the insulating glass pane 1 on the underlying frame. The shield 25 may as shown overlap the weather screen 5*b* on the main frame bottom member 4*b*, such that a complete protection of the wooden parts of the bottom members of the frame and main frame against weathering and drained off condensation water may be obtained.

I claim:

1. A window having a frame comprising a top member, a bottom member and side members, each of said side members being formed with a recess having a bottom wall and a side wall, for receiving side edges of an insulating glass pane with an inner side of said pane facing the bottom wall of said recess, external glazing profiles for arrangement on external sides of said side and bottom members to retain said pane in said recesses and against said bottom member and a sealing arrangement comprising first and second sealing profiles of an elastomeric material for arrangement between the inner side of said pane and opposing surfaces of said recesses and said frame bottom member, respectively, said first sealing profile being provided with a first pair of projecting flaps facing the window opening and providing a drainage channel extending in the longitudinal direction of the respective frame side members, said second sealing profile forming against the inner side of the pane a substantially V-shaped drainage channel and being formed at the side facing said pane at each of two corner joints between the frame bottom and side members with a depression forming a drainage opening, said first and second sealing profiles crossing each at said corner joint to provide a drainage communication between said longitudinally extending drainage channel in said first sealing profile and said drainage opening.

2. A window as claimed in claim 1 wherein said first sealing profile is formed with a second pair of projecting flaps against the side wall of said recess to provide an additional drainage channel.

3. A window as claimed in claim 1, wherein said second sealing profile is attached to a projecting nose portion of said frame bottom member to locate said second profile in contact with the inner side of said pane, said depression of the second sealing profile being formed against a part of said frame bottom member at each of said corner joints outside said projection nose portion.

4. A window as claimed in claim 1, wherein said first sealing profile is formed with a groove for attachment to a rib portion projecting from the bottom wall of said recess.

5. A window as claimed in claim 3, wherein said second sealing profile is formed with a projecting bead for engagement with a groove formed in said frame bottom member outside said nose portion and on the side thereof facing the window opening.

* * * * *